US005465504A

United States Patent [19]

Joiner

[11] Patent Number: 5,465,504

[45] Date of Patent: Nov. 14, 1995

[54] SYSTEM FOR MODIFYING THE MOISTURE PROFILE OF A PAPER WEB

[75] Inventor: John R. Joiner, Vancouver, Wash.

[73] Assignee: James River Paper Company, Inc., Richmond, Va.

[21] Appl. No.: 224,735

[22] Filed: Apr. 8, 1994

[51] Int. Cl.[6] ..... F26B 3/00

[52] U.S. Cl. ..... 34/446; 34/551; 34/114; 34/112; 34/111

[58] Field of Search ..... 34/110, 111, 114, 34/116, 122, 123, 444, 445, 446, 549, 551

[56] References Cited

U.S. PATENT DOCUMENTS

| | | | |
|---|---|---|---|
| 2,268,988 | 1/1942 | Hess et al. | 34/122 |
| 3,163,502 | 12/1964 | Justus et al. | 34/114 |
| 3,293,770 | 12/1966 | Rauskolb | 34/551 |
| 3,377,056 | 4/1968 | Boye | 34/122 |
| 4,590,685 | 5/1986 | Roth | 34/31 |
| 4,942,675 | 7/1990 | Sundovist | 34/446 |

*Primary Examiner*—Denise L. Gromada
*Attorney, Agent, or Firm*—Thomas R. Lampe

[57] ABSTRACT

A paper web in a paper machine including a yankee dryer is dried and the moisture profile thereof controlled by arraying a plurality of gas burners in a cross-machine direction within the hood of the yankee dryer to direct heat toward different incremental width portions of the paper web. The burners are independently controlled by a scanning moisture gauge.

15 Claims, 2 Drawing Sheets

SYSTEM FOR MODIFYING THE MOISTURE PROFILE OF A PAPER WEB

TECHNICAL FIELD

This invention relates to the art of drying paper webs. More particularly, the invention encompasses an apparatus and a method for controlling or modifying the moisture profile of a paper web produced by a paper making machine. The system has particular applicability to yankee dryers in tissue machines.

BACKGROUND ART

It is important to control the cross-machine moisture profile on paper making machines such as tissue machines. Poor moisture profiles can result in a wide variety of operational problems, particularly in tissue converting operations.

A number of cross-directional moisture profile control devices are commercially available. These include steam boxes, electromagnetic induction devices, electric and gas infrared radiation devices, and profiling dampers.

The above-identified prior art devices are generally characterized by their inability to deliver more than a few per cent of the total drying energy of the dryer system. Consequently, none of the devices is truly effective insofar as correction of the moisture profile of a paper web is concerned. Also, many such prior art arrangements are characterized by their complexity and relatively high expense.

A patentability search directed to the present invention located the following U.S. Pat. Nos.: 2,268,988, issued Jan. 6, 1942, 3,163,502, issued Dec. 29, 1964, and 3,377,056, issued Apr. 9, 1968. None of the three located patents address the problem of moisture profile variations in a cross-machine direction.

U.S. Pat. No. 3,377,056 discloses a hood having a main housing and sub-housings on either side thereof. Cooling and heating components are located in the sides of the housing. Burners are provided in the walls of plenum chambers for heating the air supplied to the paper web positioned on a yankee dryer.

U.S. Pat. No. 2,268,988 discloses a manifold disposed around a drum. Burners are positioned around the circumference of the drum in order to heat ink which is positioned on paper transported around the outer surface of the drum.

U.S. Pat. No. 3,163,502 is directed to a removable hood for drying a web of material conveyed around cylinders. Heating ducts are provided in each of the hood sections. Gas heated by a fire tube may be substituted for the heater ducts. The ducts are essentially identical and each provides a passage at opposite ends communicating with an exhaust air chamber.

DISCLOSURE OF INVENTION

The present invention provides a relatively simple, highly effective approach to control moisture profiles of tissue or other paper webs produced by a paper making machine.

The apparatus of the present invention includes a rotatable heated dryer drum having an outer cylindrical surface for transporting a paper web in the machine direction of a paper making machine and drying the paper web during transport upon rotation of the dryer drum.

A hood defines an interior at least partially encompassing the rotatable heated dryer drum.

Heater means is operatively associated with the hood and the drum to modify the moisture profile of the paper web as it is transported by the drum through the hood interior. The heater means comprises a plurality of independently operable gas burners arrayed in the cross-machine direction adjacent to the drum within the hood interior and burner control means for independently controlling each of the burners to control the heat emitted thereby.

The burners direct heat to respective different incremental width portions or slices of the paper web being transported by the dryer drum through the hood interior to modify the moisture profile of the paper web.

In the disclosed preferred embodiment, each burner includes an aspirator and a burner nozzle connected to the aspirator. Air supply means and flammable gas supply means are in operative association with the burner aspirators to respectively simultaneously supply combustion air and flammable gas to the burners.

Moisture profile sensing means is provided for sensing the moisture profile of the paper web after the paper web has been removed from the outer cylindrical surface of the heated dryer drum. The moisture profile sensing means and the burner control means are in operative association to separately control operation of the burners and vary the heat emitted thereby responsive to the web moisture profile sensed by the moisture profile sensing means.

According to the method of the present invention, a plurality of independently operable gas burners are positioned in the cross-machine direction adjacent to a dryer drum and extending along the length of the dryer drum, the gas burners each including a nozzle.

The dryer drum is rotated to deliver a paper web in the machine direction into and through the hood interior and past the gas burner nozzles.

The paper web is dried on the dryer drum outer cylindrical surface and the paper web is removed from the dryer drum.

The paper web is monitored along the width thereof after the paper web has been removed from the dryer drum to determine the moisture profile of the paper web after drying thereof.

The heat emitted by the gas burner nozzles are selectively and separately controlled as a function of the moisture profile determined during the monitoring step to direct flows of heated air to incremental width portions or slices of the paper web while on the dryer drum to modify the moisture profile of the web produced by the paper making machine.

Other features, advantages, and objects of the present invention will become apparent with reference to the following description and accompanying drawings.

BEST MODE FOR CARRYING OUT THE INVENTION

Figure 1:
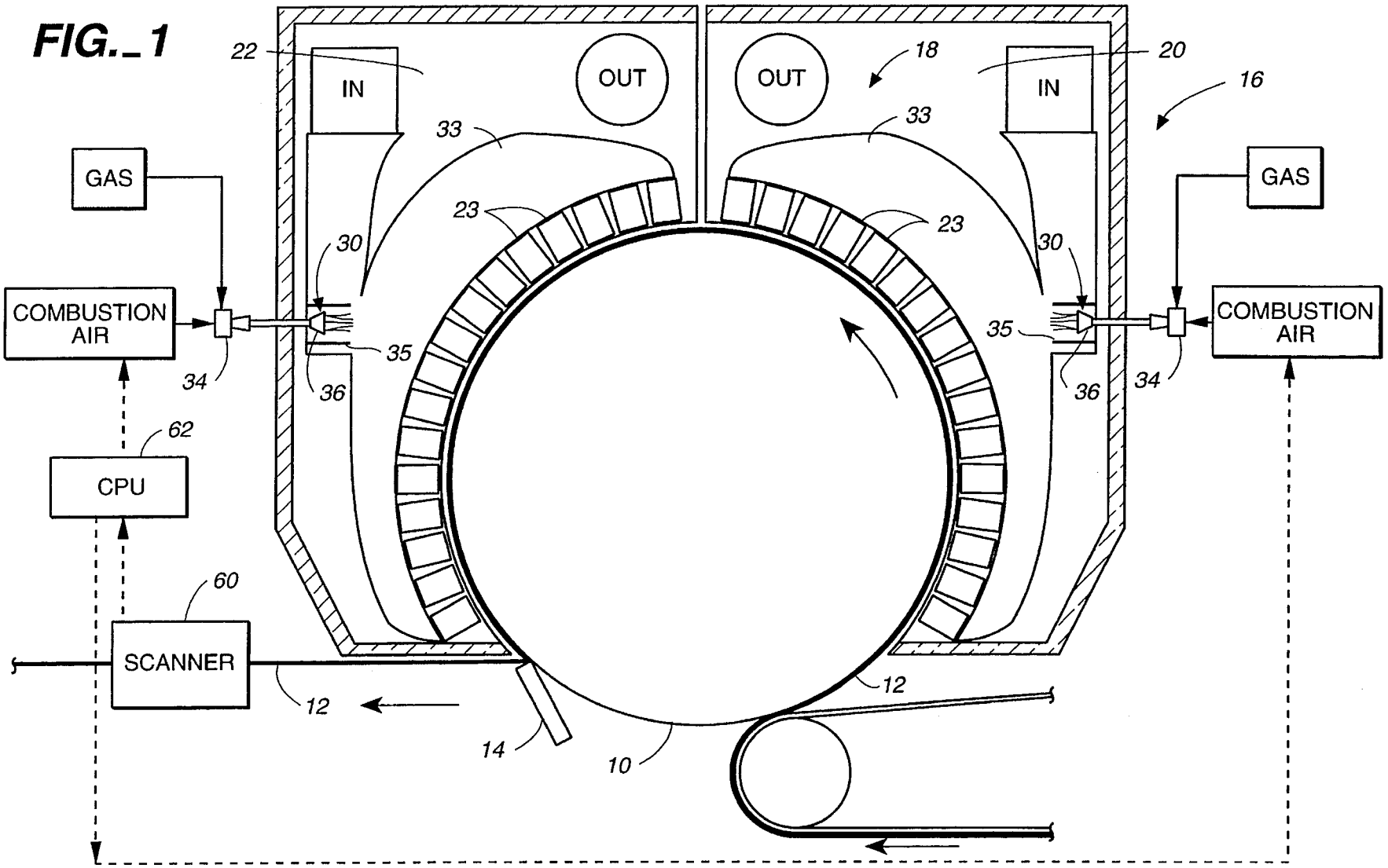
FIG. 1 is a schematic, elevational view of a yankee dryer in combination with apparatus constructed in accordance with the teachings of the present invention.

Referring now to the drawings, a yankee dryer includes a rotatable heated dryer drum 10. The drum has an outer cylindrical surface for transporting a wet paper web 12 (FIG. 1) in the machine direction and for drying the paper web during transport. In the arrangement illustrated, the web 12 is shown being creped from the dryer drum by a creping blade 14 as is conventional in tissue manufacturing processes.

The yankee dryer also includes a hood 16 defining an interior 18 partially encompassing the rotatable heated dryer drum. The hood has a wet end compartment 20 and a dry end compartment 22.

In conventional yankee dryer set-ups, the paper web is dried by both the heated drum and by heated air flow within the hood interior. While yankee dryers quickly and effectively dry wet paper webs, as stated above, variation in moisture profiles of the webs is an ongoing problem. Yankee hoods typically deliver about 60 per cent of the total drying energy of a yankee dryer and the present invention makes effective use of that fact to effectively correct poor moisture profiles, in a manner which will now be discussed.

Heater means of a specific character and placement is operatively associated with the hood and the drum to modify the moisture profile of the paper web 12 as it is transported by the drum through the hood interior 18. The heater means also can contribute in large measure to the actual drying of the paper web as it is transported by the drum through the hood interior.

Figure 2:
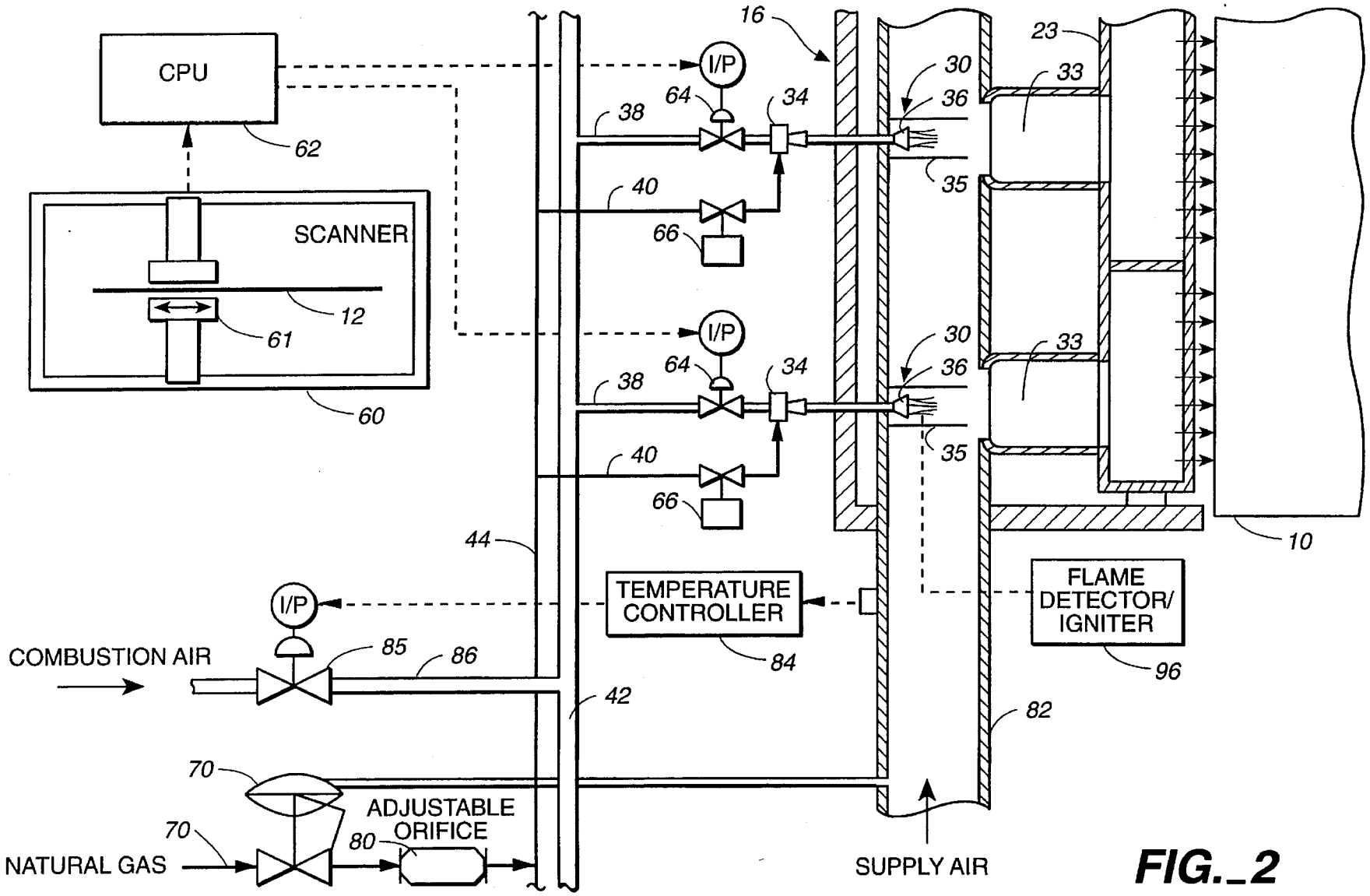
FIG. 2 is a schematic, plan view illustrating selected structural components of the present invention.

A plurality of nozzle boxes 23 are arrayed about the dryer drum to deliver heated dryer air to the web, as depicted schematically by the arrows exiting the nozzle box 23 in FIG. 2. The heater means further includes a plurality of independently operable gas burners 30 arrayed in the cross-machine direction adjacent to the drum within the hood interior. Burner control means (which will be described below) is provided for independently controlling each of the burners 30 to control the heat emitted thereby. The gas burners are, as shown in FIG. 1, disposed in both the wet end hood compartment and the dry end hood compartment. FIG. 2, in the interest of simplicity, shows only two burners 30 and only those burners which are located in one compartment of the hood. The structure and principals of operation described below will be applicable to all of the burners in both the wet end hood compartment and the dry end hood compartment.

An essential feature of the present invention resides in the fact that the burners direct heat to different incremental width portions or slices of the paper web being transported by the dryer drum through the hood interior. For example, a gas burner 30 may be disposed every six inches across the dryer drum, i.e. in the cross-machine direction. The burners each direct heat toward their respective slices or incremental width portions of the web. In the arrangement shown, the burners direct heat with passageways 33 in alignment therewith, said passageways being the interiors of crescent headers supporting nozzle boxes 23 and headers to the interiors of nozzle boxes 23. In other words, each nozzle box 23 receives heat from a plurality of burners 30 arrayed in the cross-machine direction along the nozzle box. A shield 35 about each burner 30 directs nozzle heat toward its respective crescent header.

Burners 30 each include an aspirator 34 exiting at a burner nozzle 36. The aspirators and nozzles are shown schematically and may be of any suitable known commercial type.

As can be seen in FIG. 2, each aspirator 34 is connected to an air supply line 38 and a flammable gas supply line 40. The air supply lines 38 lead to an air manifold 42 while flammable gas supply lines 40 lead to flammable gas manifold 44. A suitable form of flammable gas is natural gas. Air manifold or header 42 receives combustion air from a suitable source (not shown) thereof.

After paper web 12 has been creped from dryer drum 10, it passes through a scanning moisture gauge 60 of any suitable commercial type which includes a scanning element 61 which traverses the paper web in a cross machine direction to sense the moisture profile thereof. Scanning moisture gauges are, for example, made available by Asea Brown Boveri, Columbus, Ohio and Measurex Corporation, Cupertino, Calif. The sensed moisture profile information is transmitted to a suitably programmed central processing unit 62.

The central processing unit is operatively associated with a control valve 64 operatively associated with each of the air supply lines 38 to control the flow of air through each of the air supply lines and respective aspirator. The air passing through the aspirators draws flammable gas through lines 40 into the aspirators. Many aspirators are commercially available which utilize the venturi effect to accomplish such end result. With such an arrangement, gas pressure within the flammable gas supply lines and related flammable gas manifold can be quite small. Preferably, each flammable gas supply line 40 has operatively associated therewith a solenoid operated shut-off valve 66 which will terminate flow of flammable gas to the aspirator in the event of one or more occurrences, such as flameout of the respective burner, taking place.

Means is also preferably provided to regulate the flow of natural gas or other flammable gas from its supply source to the flammable gas manifold 44. FIG. 2 shows a gas supply line 70 leading to manifold or header 44. A backpressure regulator 72 controls flow of gas through an adjustable orifice valve 80 in line 70. The backpressure regulator controls the gas pressure at the regulator to match the supply air pressure. The adjustable orifice provides a means to adjust the fuel to air ratio for all the burners with a single adjustment. This restriction results in the gas header pressure being slightly less than the supply air pressure.

The burner nozzles 36 are located within a supply air duct 82 which receives air exiting the hood interior. The air is recirculated back through the hood by one or more recirculating fans (not shown) as is conventional. In the present arrangement, the supply air is directed by each supply air duct to passageways 33 and thence into the interiors of nozzle boxes 23. The supply air mixes with the heated gases exiting the burner nozzles. A temperature controller 84 monitors the temperature of the supply air and cooperates with a flow regulating valve 85 to regulate the flow of combustion air through a combustion air supply line 86 leading from a source (not shown) of pressurized air to air manifold 42.

For proper operation of the system it is also desirable that the pressure of the natural gas entering header 42 from line 70 be the same as the supply air pressure, and this is accomplished through a lead line 90 extending between the interior of supply air duct 82 to pressure regulator 72.

Each nozzle burner has operatively associated therewith means for detecting a flame at the burner nozzle and for igniting the burner. Such devices are readily commercially available and will not be described in detail. FIG. 2 depicts a combined flame detector/igniter device 96 operatively associated with only one of the gas burners 30 in the interest of simplicity.

I claim:

1. Apparatus comprising, in combination:

a rotatable heated dryer drum having an outer cylindrical surface for transporting a paper web in the machine direction of a paper making machine and drying said paper web during transport upon rotation of said dryer drum;

a hood defining an interior at least partially encompassing said rotatable heated dryer drum;

heater means operatively associated with said hood and said drum to modify the moisture profile of the paper web as it is transported by said drum through said hood interior, said heater means comprising a plurality of independently operable gas burners arrayed in the cross-machine direction adjacent to said drum within said hood interior and burner control means for independently controlling each of said burners to control the heat emitted thereby, said burners directing heat to respective different incremental width portions of the paper web being transported by the dryer drum through the hood interior to modify the moisture profile of the paper web; and moisture profile sensing means for sensing the moisture profile of the paper web after said paper web has been removed from the outer cylindrical surface of said heated dryer drum, said moisture profile sensing means and said burner control means being in operative association to separately control operation of said burners and vary the heat emitted thereby responsive to the moisture profile sensed by said moisture profile sensing means.

2. The apparatus according to claim 1 wherein said burners each include an aspirator and a burner nozzle connected to said aspirator, said apparatus additionally comprising air supply means and flammable gas supply means in operative association with the burner aspirators to respectively simultaneously supply air and flammable gas to said burners.

3. The apparatus according to claim 2 wherein said flammable gas supply means includes a flammable gas supply line connected to each of said aspirators and wherein said air supply means includes an air supply line connected to each of said aspirators, said burner control means including a control valve operatively associated with each of said air supply lines to control the flow of air through each said air supply line and respective aspirator.

4. The apparatus according to claim 3 wherein said flammable gas supply means additionally includes a flammable gas manifold for containing flammable gas, said flammable gas supply lines being connected to said flammable gas manifold to deliver flammable gas from said flammable gas manifold to said aspirators, and wherein said air supply means additionally includes an air manifold for containing air, said air supply lines being connected to said air manifold to deliver air from said air manifold to said aspirators.

5. The apparatus according to claim 2 additionally comprising shields disposed in said hood interior, said shields being separated from each other and disposed between adjacent burner nozzles, the shields extending toward the outer cylindrical surface of said heated dryer drum.

6. The apparatus according to claim 1 wherein said burner control means includes an adjustable control valve operatively associated with each of said burners to control the flow of air and flammable gas to said burners, at least some of said adjustable control valves of said burner control means being separately and independently adjustable responsive to the paper web moisture content sensed by said moisture profile sensing means at the respective incremental width portions of the paper web.

7. The apparatus according to claim 4 additionally comprising air supply conduit means for recirculating supply air exiting said hood interior back into said hood interior.

8. The apparatus according to claim 2 additionally comprising ignition means operatively associated with each of said burner nozzles to ignite said burner nozzles.

9. The apparatus according to claim 2 additionally comprising flame detector means operatively associated with each of said burner nozzles to detect the existence of flame emitted by said burner nozzles.

10. The apparatus according to claim 7 additionally comprising flammable gas regulating means for regulating the pressure of flammable gas to match supply air pressure and adjustable flow restrictor means for adjusting the ratio of flammable gas to air.

11. The apparatus according to claim 1 wherein the hood has a wet end compartment and a dry end compartment, said burners being located in both the wet end compartment and the dry end compartment of said hood.

12. The apparatus according to claim 3 including a gas cut-off valve disposed in each flammable gas supply line.

13. The apparatus according to claim 1 additionally comprising a plurality of crescent headers in said hood interior, said burners directing heat into the interiors of said crescent headers.

14. The apparatus according to claim 13 additionally comprising a plurality of heater nozzle boxes extending in the cross-machine direction and connected to said crescent headers for receiving heated air from the interiors of said crescent headers and directing said heated air toward said dryer drum.

15. A method of modifying the moisture profile of a paper web produced on a paper making machine including a rotatable dryer drum having an outer cylindrical surface and a dryer hood partially encompassing said dryer drum and having a hood interior, said method comprising the steps of:

positioning a plurality of independently operable gas burners in the cross-machine direction adjacent to said dryer drum and extending along the length of the dryer drum, said gas burners each including a nozzle;

rotating said dryer drum to deliver the paper web in the machine direction into and through the hood interior and past the gas burner nozzles;

drying the paper web on said dryer drum outer cylindrical surface;

removing the paper web from the dryer drum;

monitoring the paper web along the width of the paper web after the paper web has been removed from said dryer drum to determine the moisture profile of the paper web after drying of the paper web; and selectively and separately controlling the flames emitted by said gas burner nozzles as a function of the moisture profile determined during said monitoring step to direct flows of heated air to incremental width portions of said paper web while on said dryer drum to modify the moisture profile of the web produced by the paper making machine.

* * * * *